United States Patent [19]

Papworth

[11] 4,015,613

[45] Apr. 5, 1977

[54] TANK CLEANING APPARATUS

[76] Inventor: Charles A. Papworth, 1018 SW. 21st St., Ft. Lauderdale, Fla. 33315

[22] Filed: Oct. 17, 1975

[21] Appl. No.: 623,438

[52] U.S. Cl. ..... 134/102; 134/111; 134/113; 134/168 R; 15/346; 239/127; 239/599

[51] Int. Cl.[2] ..... B08B 3/02; B08B 9/08

[58] Field of Search ..... 134/102, 111, 113, 166 R, 134/167 R, 168 R, 169 R, 169 A; 15/345, 346; 239/127, 599, 601

[56] References Cited

UNITED STATES PATENTS

| | | | |
|---|---|---|---|
| 787,389 | 4/1905 | Moorhead | 15/345 |
| 868,901 | 10/1907 | Williams | 15/345 |
| 1,552,998 | 9/1925 | Menge | 134/111 |
| 2,243,446 | 5/1941 | Terlesky et al. | 134/167 R X |
| 2,910,077 | 10/1959 | Blake et al. | 134/168 R |
| 3,428,257 | 2/1969 | Kentfield et al. | 239/599 X |
| 3,808,631 | 5/1974 | Shibata et al. | 134/175 X |

*Primary Examiner*—Robert L. Bleutge
*Attorney, Agent, or Firm*—Oltman and Flynn

[57] ABSTRACT

This apparatus has a unitary, flexible hose assembly with an inner hose for discharging fuel or other liquid under pressure into a tank to agitate its contents and an outer hose for withdrawing the liquid and entrained impurities from the tank. A pump and filters on a wheeled cart are detachably connected to the opposite end of the hose assembly to continuously recirculate and clean the liquid without intermediate storage of the liquid before it is returned to the tank. The discharge end of the inner hose and a nozzle thereon project several inches beyond the inlet end of the outer hose. An adjustable valve introduces air into the recirculated liquid stream between the outer hose and the pump inlet to increase the turbulence effect inside the tank. For the same purpose the outer hose may be formed with one or more openings near its inlet end.

27 Claims, 7 Drawing Figures

Fig. 1
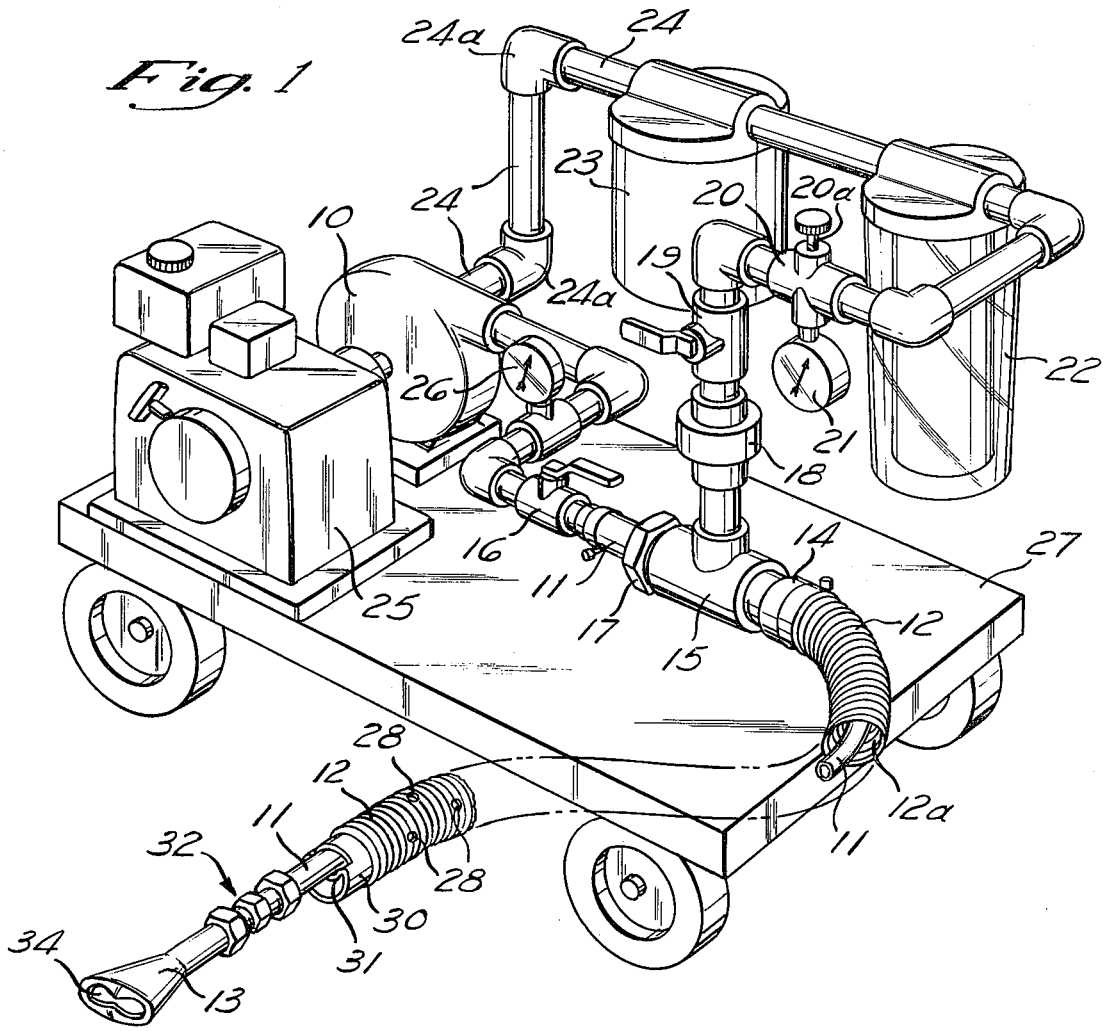
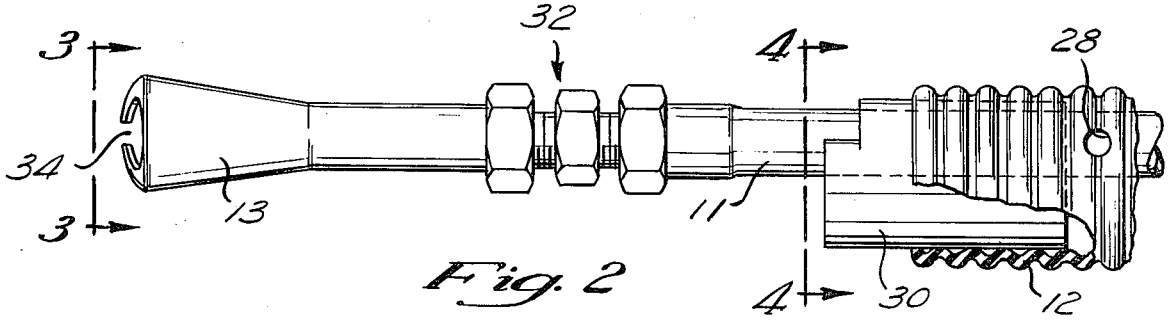
Fig. 2
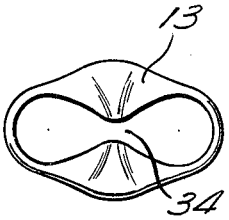
Fig. 3
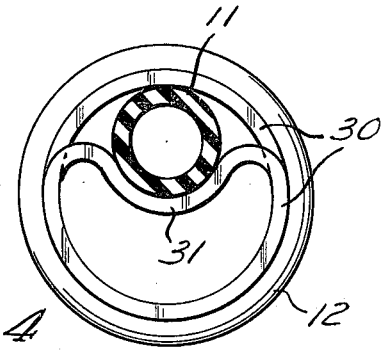
Fig. 4

Fig. 5
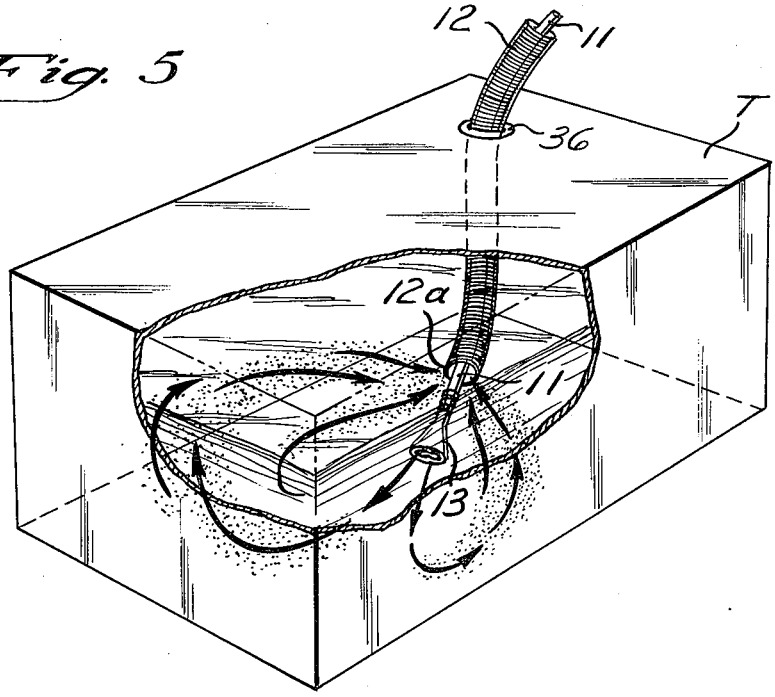
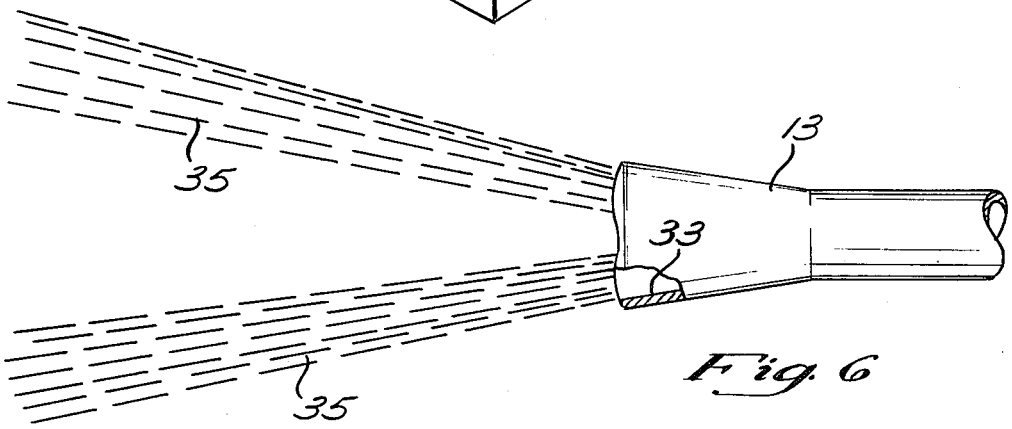
Fig. 6
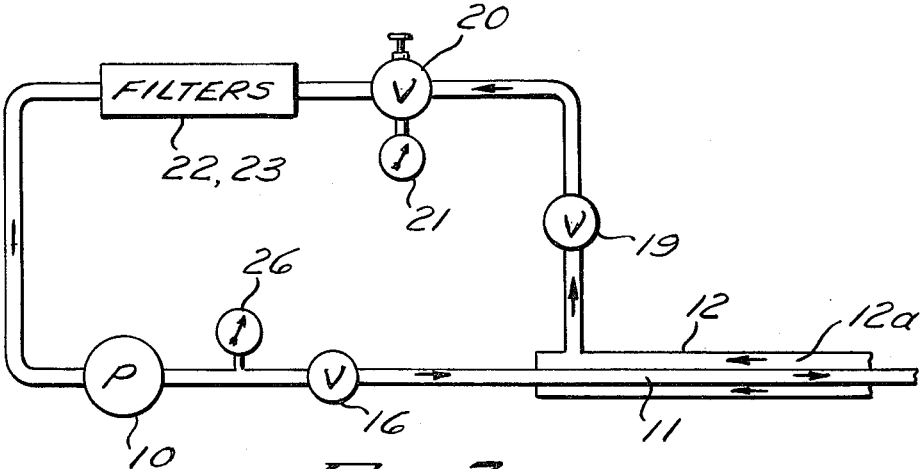
Fig. 7

TANK CLEANING APPARATUS

BACKGROUND OF THE INVENTION

One of the problems with late model American cars, which may be related to the use of unleaded gasoline, is the contamination of the gas tank with impurities. The problem often is so serious as to require removal of the gas tank from the car and steam-cleaning of its interior, followed by re-attachment of the gas tank to the car. This is a time consuming and expensive procedure.

The same problem of keeping the fuel tank clean exists with power boats, also.

Prior to the present invention there have been various proposals for recirculating oil or the like through a pump and a filter to keep it clean. Examples of such prior arrangements are disclosed in the following U.S. Pat. Nos.: Vokes, 2,499,705; Busby, 2,685,347; and Vawter, 2,425,848. However, such prior proposals were not adapted for cleaning fuel tanks on cars and power boats.

SUMMARY OF THE INVENTION

The present invention is directed to a novel and improved apparatus for cleaning tanks which contain liquid, particularly fuel tanks on cars, power boats and other vehicles.

In accordance with the preferred embodiment of this invention, a pump and filters, mounted on a wheeled cart, are connected to a unitary, flexible hose assembly having an outer hose through which fuel is withdrawn from the tank and an inner hose extending along the inside of the outer hose for discharging recirculated, filtered fuel under pressure back into the tank substantially immediately without intermediate storage to stir up the contents of the tank with sufficient turbulence to cause the impurities to be withdrawn along with the fuel through the outer hose. The discharge end of the inner hose and a nozzle thereon extend beyond the inlet end of the outer hose, preferably by several inches, to produce an optimum agitating effect inside the tank which facilitates the withdrawal of sludge, sediment, small particles or other impurities along with the fuel that is being recirculated. These impurities are removed by the filters and the fuel that goes back into the tank via the inner hose is is substantially free of such impurities. The outside diameter of the outer hose is such that it has an easy sliding fit in the opening leading into the fuel tank, which now is usually not more than 1¼ inches for both boats and automobiles.

A principal object of this invention is to provide a novel and improved tank cleaning apparatus which has a unitary, flexible hose assembly comprising outer and inner hoses for insertion into the tank to withdraw the usual liquid contents and impurities from the tank through the outer hose and to return the filtered liquid in a continuous recirculating flow substantially immediately without intermediate storage through the inner hose back to the tank in a pressurized stream which stirs up the contents of the tank.

Further objects and advantages of this invention will be apparent from the following detailed description of a presently-preferred embodiment thereof, which is shown in the accompanying drawings, in which:

FIG. 1 is a perspective view of the present tank cleaning apparatus;

FIG. 2 is a side elevational view, with parts broken away for clarity, showing the end of the hose assembly that is inserted in the tank to be cleaned;

FIG. 3 is an end elevational view of the discharge nozzle for the inner hose at this end of the hose assemlby, taken from the line 3—3 in FIG. 2; and FIG. 4 is a cross-section taken along the line 4—4 in FIG. 2;

FIG. 5 is a schematic perspective view showing the hose assembly inserted into a fuel tank on a power boat to agitate its contents by discharging fuel under pressure into the tank and to draw off fuel and foreign matter to be filtered out before the fuel is returned to the tank;

FIG. 6 is an elevational view showing the fuel discharge pattern produced by the nozzle on this hose assembly; and FIG. 7 is a simplified schematic diagram showing the flow path for the fuel recirculated by the present apparatus.

Referring to FIG. 1, the present apparatus comprises a pump 10 of known design suitable for pumping gasoline, diesel fuel or the like, having its outlet operatively connected to one end of a flexible inner hose 11 which for most of its length extends longitudinally through a flexible outer hose 12. At its opposite end (away from the pump) the inner hose 11 projects beyond the corresponding end of the outer hose 12 and carries a discharge nozzle 13 of brass or other suitable material. The outside diameter of the inner hose 11 is substantially smaller than the inside diameter of the outer hose 12 so that an annular suction return passageway **12*a* is provided between them, running along the complete length of the outer hose. The hose assembly, made up of the outer hose 12 and the inner hose 11**, is readily flexible to facilitate its handling by the user.

In the use of this apparatus the nozzle end of the hose assembly is inserted into the gas tank so that the nozzle 13 on the inner hose is positioned to discharge fuel into the tank and the adjacent inlet end of the outer hose 12 is positioned to receive fuel from inside the tank to be conducted along the return passageway **12*a*** between the outer and inner hoses in the opposite direction from the fuel flow along the inside of the inner hose.

The opposite end of the outer hose 12 (remote from the nozzle 13 on the inner hose) is attached in fluid-tight fashion, such as by hose clamps 14, to one end of a T-fitting 15, which has a longitudinal passage and a branch passage intersecting the longitudinal passage midway along its length. The inner hose 11 extends completely through the longitudinal passage in the T-fitting and beyond the opposite end of this fitting is connected to a manual shutoff valve 16 at the outlet side of the pump 10. A suitable annular plug 17 is threaded into this end of the T-fitting 15 in fluid-tight fashion and it is sealed in fluid-tight fashion to the outside of the inner hose 11 to prevent leakage at this end of the T-fitting.

The branch passage in the T-fitting 15 is connected through a manually disconnectable pipe coupling 18 to an inlet at the lower end of a manual shutoff valve 19. This valve has an outlet at its upper end which is connected to the inlet of an air bleed valve 20, which has a threadedly adjustable screw for selectively controlling the admission of ambient air into this valve. A pressure gauge 21 is connected to valve 20 to measure the fluid pressure inside this valve, thereby indicating the extent of the partial vacuum established in the return passageway 12*a* in the outer hose 12.

The outlet of valve 20 is connected to the inlet of a first filter 22. In the preferred embodiment, this filter has a casing which is transparent for at least part of its extent and a 180-mesh wire cloth filter element inside this casing for filtering out foreign particles in the fuel. The first filter 22 has both an inlet fitting and an outlet fitting at its upper end.

A second filter 23 has its inlet connected to the outlet of the first filter 22. In one practical embodiment, this second filter is a "Fram" fuel filter of known design having a replaceable filter cartridge and having inlet and outlet fittings at its upper end.

The outlet of the second filter 23 is connected through pipes 24 and elbow fittings 24*a* to the inlet of the pump 10, which is driven by a gasoline engine 25. A pressure gauge 26 is connected to the outlet side of the pump to sense the fluid pressure there ahead of the manual shutoff valve 16.

A wheeled cart 27 supports all the components of the apparatus at the back end of the hose assembly, including the pump 10 and its engine 25, the T-fitting 15, the filters 22 and 23, the valves 16, 19 and 20, the pressure gauges 21 and 26, and the various pipes and fittings which rigidly interconnect and physically support these components.

In the operation of this apparatus, with the shutoff valves 16 and 19 opened, the pump 10 is turned on to pump gasoline, diesel fuel or other fuel through the inner hose 11 of the hose assembly to the nozzle 13 on its opposite end. This fuel is discharged under pressure into the fuel tank being cleaned and it stirs up the interior of the tank so that foreign matter is drawn up, along with fuel, into the return passageway 12*a* between the outer hose 12 and the inner hose 11. This action is shown schematically in FIG. 5. This return stream is drawn in a continuous recirculating flow back to the inlet side of the pump 10 after flowing through valves 19 and 20 and filters 22 and 23 in succession. Most of the foregin matter in the recirculated fuel is trapped by the wire cloth filter element in the first filter 22. From time to time, as determined by visual inspection through the transparent casing of this filter, this wire mesh filter element should be removed for cleaning.

The turbulence inside the tank that is produced by the fuel discharged under pressure by the nozzle 15 may be increased or decreased by appropriately adjusting the air bleed valve 20 so as to admit more or less air into the recirculated fuel stream. The more air admitted at this valve, the greater the turbulence in the tank being cleaned.

As shown in FIG. 1, the outer hose 12 may be formed with one or more openings 28 near its inlet end for introducing air into the fuel stream returning via passageway 12*a* in the outer hose to the pump inlet, so as to increase the turbulence in the tank being cleaned. These openings may be in place of, or in addition to, the air bleed valve 20 for the same purpose.

As best seen in FIG. 2, the outer hose 12 preferably is of corrugated configuration on the outside due to the presence of a helically wound reinforcing wire embedded in the plastic wall of this hose. A generally cylindrical brass fitting 30 has a tight fit in the inlet end of the outer hose 12 (remote from the T-fitting 15). At its outer end (beyond the outer hose 12), the peripheral wall of the end fitting 30 is offset inwardly as shown at 31 in FIG. 4 to provide a generally U-shaped cradle for the inner hose 11. The inner hose passes snugly between the cylindrical wall of the fitting 30 and this inwardly-offset wall segment 31 as it emerges from the outer hose 12 so that it is held relatively snugly by this fitting.

The inner hose 11 preferably is of fabric-reinforced rubber and it projects an inch or more beyond the end fitting 30. In one practical embodiment, the inner hose 11 has an inside diameter of ⅜ inch and the pressure of the fuel in this hose is about 18 or 20 pounds per square inch. The discharge nozzle 13 is connected to the inner hose by suitable tube fittings 32 of known design.

The inner hose 11, fittings 32 and nozzle 13 together project 7½ inches beyond the end fitting 30 on the outer hose 12 in the present-preferred embodiment of this invention. The extent of this projection may vary, depending upon the particular fuel tank being cleaned, the location of its baffles, and the output pressure of the pump 10. The discharge opening at the nozzle 15 should be located far enough beyond the end fitting 30 to insure that the fuel discharged from the inner hose 11 is projected into the fuel tank to agitate its contents, in the manner depicted in FIG. 5, before being drawn back into the return hose 12. That is, the stirring or agitating action that takes place in the fuel tank depends in part upon the fact that the discharge from the inner hose is at least a few inches beyond the end fitting 30 on the outer return hose 12. At the same time, excessive flexibility of this projecting portion of the inner hose 11 and its nozzle 13 should be avoided so that the user can control the direction of the discharge by manipulating the outer hose 12. If the projecting length of the inner hose 11 is too great, it might be so easily flexible that the user would not be able to control with sufficient precision the direction of the discharge from the nozzle 13.

As shown in FIG. 6, the nozzle preferably has a passageway 33 that diverges toward the discharge end of the nozzle and has a discharge opening 34 (FIG. 3) of generally figure-8 configuration, having two rounded lobes connected by a reduced neck. Various other shapes may be provided for the nozzle passageway and discharge opening, but the configuration shown has been found highly effective in producing the desired degree of turbulence in the tank being cleaned. As shown in FIG. 6, the nozzle 13 discharges two fairly distinct diverging streams of fuel into the tank so that a relatively large area at the bottom of the tank may be swept by turning the nozzle 13 back and forth.

The maximum outside diameter of the outer hose 12 preferably is not more than 1¼ inches, and the maximum cross-sectional dimension of the nozzle 13 is less than this, so that this end of the hose assembly can be inserted down through the usual inlet opening 36 on the fuel tank T. Virtually all fuel tanks on power boats and passenger cars have an inlet opening of at least 1¼ inches in diameter.

As indicated schematically in FIG. 5, the fuel discharged under pressure from the inner hose 11 through the nozzle stirs up particles of dirt or other foreign matter at or near the bottom of the fuel tank. These impurities become suspended or entrained in the fuel and are drawn back with the fuel through the end fitting 30 and into the return passageway 12*a* in the outer hose 12 due to the suction exerted by the pump 10. These impurities are removed in the filters 22, 23 and clean fuel is returned in a continuous recirculating flow to the tank via the inner hose 11 substantially immediately without intermediate storage.

As already mentioned, the introduction of air into the recirculated stream has a significant effect on the turbulence produced inside the fuel tank being cleaned. In the illustrated embodiment, the air is introduced at valve 20 ahead of the filters and near the inlet end of the outer hose 12.

The flexible, non-collapsible, reinforced construction of the outer hose 12 enables it to be turned by the user so as to control the direction and location of the fuel discharge into the tank through the inner hose 11 and its discharge nozzle 13. The fitting 30 on the inlet end of the outer hose 12 provides a sufficiently snug mechanical coupling to the inner hose 11 that the latter will be turned and directed substantially in unison with the outer hose when the user manipulates the outer hose.

It is to be understood that one of the principal impurities in the fuel tank may be water, and the fuel filter in the present apparatus should be designed to remove water, as well as other impurities.

With relatively minor modifications, the present tank cleaning apparatus may be adapted for cleaning tanks which normally contain liquids othern than gasoline or other fuel. For example, it may be used for cleaning water tanks on boats by replacing the fuel filters by water filters, such as those containing activated charcoal.

I claim:

1. In an apparatus for cleaning a tank which is at least partly full of liquid, said apparatus comprising a pump for withdrawing liquid from the tank and pumping it back into the tank, filter means for filtering the liquid withdrawn from the tank before the liquid is returned to the tank, and a unitary flexible hose assembly comprising an outer hose and an inner hose extending along the inside of the outer hose and defining therewith a return passageway for liquid withdrawn from the tank, the improvement wherein:

said outer hose has an inlet opening at its lower end for insertion into the tank to be cleaned and having its upper end operatively connected to the inlet side of the pump to pass thereto the liquid withdrawn from the tank, said inner hose is operatively connected at its upper end to the outlet side of the pump for passing liquid therefrom under pressure through the interior of the inner hose back into the tank, said inner hose has discharge means on its lower end projecting beyond said lower end of said outer hose and having a discharge opening for discharging liquid under pressure from the inner hose into the tank to agitate the contents of the tank for withdrawal through said outer hose, and said pump is operatively connected to said inner and outer hoses to pump the liquid withdrawn through the outer hose in a continuous recirculating flow back into the inner hose substantially immediately without intermediate storage of the liquid.

2. Apparatus according to claim 1, and further comprising means for coupling said inner hose at said lower end thereof to said lower end of the outer hose for movement substantially in unison with the latter when the outer hose is manipulated.

3. Apparatus according to claim 2, wherein said discharge means on said lower end of the inner hose is a nozzle attached to the inner hose beyond said lower end of the outer hose.

4. Apparatus according to claim 1, and further comprising:

a rigid fitting snugly attached to said lower end of the outer hose and having passage means therein leading into the outer hose;

and wherein:

said inner hose at said lower end thereof extends snugly through said fitting so as to be mechanically coupled thereby to said lower end of the outer hose for movement substantially in unison with the latter when the outer hose is manipulated.

5. Apparatus according to claim 4, wherein said discharge means on said lower end of the inner hose is a nozzle attached to the inner hose beyond said fitting on the outer hose.

6. Apparatus according to claim 5, wherein said nozzle has a discharge opening which is substantially larger in one cross-sectional direction than transverse to said direction.

7. Apparatus according to claim 1, wherein said discharge means on said lower end of the inner hose is a nozzle attached to the inner hose.

8. Apparatus according to claim 1, and further comprising:

a pressure gauge connected between said outer hose and the inlet of the pump to indicate the partial vacuum thereat;

a pressure gauge connected between the outlet of the pump and said inner hose to indicate the fuel pressure thereat;

and a wheeled cart carrying said pump, said filter means and said pressure gauges.

9. Apparatus according to claim 8, wherein said filter means is connected between said outer hose and the inlet of the pump.

10. Apparatus according to claim 8, and further comprising:

a T-fitting on said cart having a longitudinal passage and a branch passage intersecting said longitudinal passage;

and wherein:

said outer hose terminates at one end of said longitudinal passage in the T-fitting and is operatively connected to the pump inlet through said branch passage;

and said inner hose extends through said longitudinal passage in the T-fitting and is operatively connected beyond the T-fitting to the pump outlet.

11. Apparatus according to claim 8, and further comprising:

a rigid fitting snugly attached to said lower end of the outer hose and having passage means therein leading into the outer hose;

and wherein:

said inner hose at said lower end thereof extends snugly through said fitting so as to be mechanically coupled thereby to said lower end of the outer hose for movement substantially in unison with the latter when the outer hose is manipulated.

12. Apparatus according to claim 11, wherein said discharge means on said lower end of the inner hose is a nozzle attached to the inner hose beyond said fitting on the outer hose.

13. Apparatus according to claim 12, wherein said nozzle has a discharge opening which is substantially larger in one cross-sectional direction than transverse to said direction.

14. Apparatus according to claim 12, and further comprising means for introducing air into the flow of liquid through said hose assembly to increase the turbulence produced in the tank.

15. Apparatus according to claim 14, wherein said last-mentioned means comprises an adjustable valve connected between said outer hose and the inlet of said pump for introducing ambient air into said flow of liquid.

16. Apparatus according to claim 14, wherein said last-mentioned means comprises one or more openings in said outer hose near its lower end.

17. Apparatus according to claim 14, wherein said filter means is connected between said outer hose and the inlet of the pump.

18. Apparatus according to claim 14, and further comprising:

a T-fitting on said cart having a longitudinal passage and a branch passage intersecting said longitudinal passage;

and wherein:

said outer hose terminates at one end of said longitudinal passage in the T-fitting and is operatively connected to the pump inlet through said branch passage;

and said inner hose extends through said longitudinal passage in the T-fitting and is operatively connected beyond the T-fitting to the pump outlet.

19. In a portable apparatus for cleaning a liquid tank while it is at least partly filled with liquid, said tank having an opening at the top which is substantially smaller than the cross-sectional size of the tank, said apparatus comprising a wheeled cart, a pump on said cart for withdrawing liquid from the tank and pumping it back into the tank, cleaning means on the cart for removing undesired constituents in the liquid withdrawn from the tank before the cleaned liquid is pumped back into the tank, and a unitary flexible hose assembly adapted to be slidably inserted from above through said top opening down into the tank, said hose assembly comprising a discharge hose and a return hose structurally coupled to each other and adapted to be handled as a single flexible unit during insertion through said opening into the tank, manipulation over the inside of the tank at the bottom and removal from the tank through said opening, said discharge hose having its upper end operatively connected to the outlet side of the pump for receiving the cleaned liquid under pressure therefrom, said return hose having its upper end operatively connected to the inlet side of the pump to pass thereto the liquid withdrawn from the tank, said return hose at its lower end having an inlet opening for withdrawing liquid from the tank;

the improvement wherein:

said discharge hose has a discharge nozzle on its lower end projecting beyond said inlet opening in the return hose and having a discharge opening for discharging the cleaned liquid under pressure into the tank to agitate the liquid in the tank before its withdrawal through said return hose, said lower end of the discharge hose with the discharge nozzle thereon and said lower end of the return hose being shaped and dimensioned to be inserted together down through said opening into the tank and to be removed together from the tank up through said opening;

and said pump is operatively connected to said return and discharge hoses to pump the liquid withdrawn through the return hose in a continuous recirculating flow back into the discharge hose substantially immediately without intermediate storage of the liquid.

20. Apparatus according to claim 19, wherein said discharge opening is substantially larger in one cross-sectional direction than transverse to said direction.

21. Apparatus according to claim 20, wherein said discharge opening is generally figure-8 shaped in cross-section.

22. Apparatus according to claim 19, and further comprising means for introducing air into the flow of liquid through said hose assembly to increase the turbulence produced in the tank.

23. Apparatus according to claim 22, wherein said last-mentioned means comprises an adjustable valve for passing ambient air into the flow of liquid through the hose assembly.

24. Apparatus according to claim 23, wherein said adjustable valve is connected between said return hose and the inlet of said pump.

25. Apparatus according to claim 22, wherein said last-mentioned means comprises one or more openings in said return hose near its lower end.

26. Apparatus according to claim 19 and further comprising a pressure gauge for indicating the partial vacuum in said return hose.

27. Apparatus according to claim 19, and further comprising a pressure gauge for indicating the pressure of the liquid delivered to said discharge hose by the pump.

* * * * *